US010589484B2

(12) United States Patent
Hedler et al.

(10) Patent No.: US 10,589,484 B2
(45) Date of Patent: Mar. 17, 2020

(54) PRESS DRIVE COMPRISING TWO WORKING AREAS

(71) Applicants: Rainer Hedler, Erfurt (DE); Marcus Kosse, Heiningen (DE); Joachim Beyer, Ravensburg (DE)

(72) Inventors: Rainer Hedler, Erfurt (DE); Marcus Kosse, Heiningen (DE); Joachim Beyer, Ravensburg (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 1241 days.

(21) Appl. No.: 14/492,162

(22) Filed: Sep. 22, 2014

(65) Prior Publication Data

US 2015/0053101 A1 Feb. 26, 2015

Related U.S. Application Data

(63) Continuation-in-part of application No. PCT/EP2013/054310, filed on Mar. 5, 2013.

(30) Foreign Application Priority Data

Mar. 23, 2012 (DE) ..... 10 2012 102 527

(51) Int. Cl.
*B30B 1/14* (2006.01)
*B30B 1/26* (2006.01)

(52) U.S. Cl.
CPC ..... *B30B 1/14* (2013.01); *B30B 1/268* (2013.01)

(58) Field of Classification Search
CPC ..... B30B 1/266; B30B 1/268; B30B 1/10; B30B 1/14; B30B 15/14; B30B 15/144; B30B 15/26; Y10T 74/18952

(Continued)

(56) References Cited

U.S. PATENT DOCUMENTS 5,520,057 A * 5/1996 Nakamura ..... G01L 5/0085 73/785
5,746,122 A * 5/1998 Gietz ..... B30B 15/0041 100/257

(Continued)

FOREIGN PATENT DOCUMENTS

DE 21 27 289 A 12/1971
DE 41 09 796 A1 10/1992

(Continued)

OTHER PUBLICATIONS

Chinese Office Action dated Sep. 1, 2015 regarding Chinese Patent Application No. 20130015590.9 and further identified as CPME1444077P.

*Primary Examiner* — Teresa M Ekiert
*Assistant Examiner* — Sarkis A Aktavoukian
(74) *Attorney, Agent, or Firm* — Ronald S. Lombard

(57) ABSTRACT

The invention relates to a press drive for a press or a press having a press drive. The invention also relates to a method for controlling the press drive by means of a control unit. The press drive is used for moving a ram of the press in a stroke direction H between an upper return point OT and a lower return point UT. It comprises a knee lever gear having a first lever and a second lever. A connecting rod engages on the knee lever of the two levers and is connected on the other end to an eccentric of an eccentric drive. The control unit can drive the eccentric drive in a first operating mode B1 or a second operating mode B2 or, in particular, also a third operating mode B3. In the first and the second operating modes B1, B2, the eccentric oscillates in a respectively different angle region W1, W2 about a rotation axis D of the eccentric drive, thus resulting in different force and movement states of the ram in both operating modes.

16 Claims, 7 Drawing Sheets

(58) Field of Classification Search
USPC ..... 100/281, 282, 283, 285, 286, 43, 48
See application file for complete search history.

(56) References Cited

U.S. PATENT DOCUMENTS

| | | | | |
|---|---|---|---|---|
| 6,595,122 | B1 * | 7/2003 | Mukai | B30B 15/0041 100/258 R |
| 2005/0145117 | A1 | 7/2005 | Du et al. | |
| 2008/0034985 | A1 * | 2/2008 | Suzuki | B30B 1/14 100/35 |

FOREIGN PATENT DOCUMENTS

| | | | | |
|---|---|---|---|---|
| DE | 4109796 | A1 * | 10/1992 | B30B 1/10 |
| DE | 4109796 | A1 * | 10/1992 | B30B 1/10 |
| DE | 198 46 951 | A1 | 4/2000 | |
| DE | 19846951 | A1 * | 4/2000 | B30B 1/14 |
| DE | 19846951 | A1 * | 4/2000 | B30B 1/14 |
| DE | 10 2005 001 878 | B3 | 8/2006 | |
| DE | 2007 022 715 | A1 | 7/2008 | |
| JP | 2000 084697 | A | 3/2000 | |
| JP | 2002 336995 | A | 11/2002 | |
| JP | 2004 017098 | A | 1/2004 | |
| TW | 2004 00106 | A | 1/2004 | |

* cited by examiner

PRESS DRIVE COMPRISING TWO WORKING AREAS

CROSS-REFERENCE TO RELATED APPLICATION

This is a continuation-in-part application of pending international application PCT/EP2013/054310 filed Mar. 5, 2013 and claiming the priority of German Application No. 10 2012 102 527.4 filed Mar. 23, 2012 which is hereby incorporated herein by reference in its entirety as though fully set forth.

BACKGROUND OF THE INVENTION

The invention relates to a press drive for a press. The press drive comprises a knee lever gear. The knee lever gear is driven by an eccentric drive that can also be referred to as a crank drive. The knee lever gear couples the eccentric drive with a ram of the press, so that the driving motion of the eccentric of the eccentric drive effects a linear motion of the ram in stroke direction.

Presses comprising knee lever gears have been generally known. Publication DE 10 2005 001 878 B3 discloses a press drive comprising a knee lever gear, wherein the ram of the press is associated with an ancillary drive. This ancillary drive is disposed to ensure sufficient ram force, in particular, in certain articulation angle regions of the lever of the knee lever gear.

Publication DE 10 2007 022 715 A1 describes a knee lever gear comprising two knee lever arrangements that can be actuated via a shared linear drive that acts on the hinged joints of the two knee lever gears. When one knee lever gear is driven via the linear drive, the transmission function relative to the extended position of the knee lever gear is symmetrical, i.e., the ram performs the same movement, irrespective of whether the hinged joint is articulated to the one or the other side, starting from the extended position.

From publication DE 21 27 289 A an adjustable knee lever drive is known. A main eccentric drives a main connecting rod that represents the first lever of the knee lever gear, said first lever being connected to the ram via a second lever. Via an auxiliary connecting rod, an auxiliary eccentric acts on one arm of a two-arm lever. The other arm of this two-arm lever is coupled with the hinged joint. The linkage points of the auxiliary connecting rod on the two-arm lever, as well as of a drive rod between the two-arm lever and the hinged joint, are adjustable. This measure is intended to allow an adjustment of the impact velocity of the ram on the tool, the travel of the ram stroke, the stroke length and the position of the lower return point of the ram.

Publication DE 198 46 951 A1 describes another press comprising a knee lever gear. The first lever of the knee lever gear is supported by the press frame, while the other lever is connected to the ram. The connection between these two levers is accomplished via a triangular control arm, so that the first lever and the second lever are supported at a distance from each other by the triangular control arm. Furthermore, the triangular control arm is connected to an eccentric drive by means of a connecting rod. The length of the connecting rod is adjustable. If the knee lever gear oscillates through an extended position, the ram is briefly moved twice in succession through a lower return point due to the kinematics of the arrangement. The location of these two lower return points differs relative to a reference point on the press frame in stroke direction. If the knee lever gear does not oscillate through its extended position, a common, approximately sinusoidal, progression of the ram position is achieved.

The disadvantage of this arrangement is the differing position of the two lower return points when the knee lever gear is moved through its extended position. Also, in many cases a changing connecting rod length is undesirable. The length change changes the course of movement of the end of the connecting rod that is connected to the hinged joint. Furthermore, an arrangement for changing the length of the connecting rod, in particular if such a change is to be accomplished by an actuating drive, is complex considering the design and considerably increases the moved mass of the connecting rod.

Referring to these described press drives, it can be viewed as an object of the present invention to provide a press drive of a simple design that, nevertheless, allows different operating modes depending on the task to be performed by the press.

SUMMARY OF THE INVENTION

This object is a achieved by a press drive displaying the features of Claim 1.

In accordance with the invention the press drive comprises a knee lever gear having a first lever and a second lever that are mounted next to each other on a hinged joint so as to be pivotable. The knee lever gear comprises a first bearing that is disposed for the pivotable support of the first lever on the press frame. Furthermore, a second bearing is provided for the pivotable support of the second lever on the ram of the press. Preferably, the first bearing is arranged on the press frame so as to be non-displaceable or immovable relative to the press frame. The position of the pivot axis of the second bearing is preferably also unchangeable relative to the ram.

Furthermore, the knee lever gear comprises a connecting rod whose one end is pivotally supported on the hinged joint. In particular, the hinged joint has a common pivot axis about which the first lever, the second lever, and the connecting rod mounted next to each other can be pivoted. The other end of the connecting rod is connected on an eccentric to an eccentric drive.

Alternatively, one of the two levers or the connecting rod may also be configured as a triangular control arm, each having three linkage points. Then, in the region of the hinged joint, there are two spaced apart linkage points. One of the two levers and the connecting rod, or the two levers, come into engagement at one linkage point, whereas the remaining lever, or the connecting rod, come into engagement at the other linkage point. In particular, the pivot axes of the two spaced apart linkage points extend parallel to each other.

A control unit is disposed for activating the eccentric drive. It is designed to drive the eccentric drive in a first operating mode or a second operating mode. In another embodiment, it is also possible for a third operating mode or additional operating modes to be provided. The selection of the suitable operating mode may take place automatically by means of the control unit in view of the detected or prespecified parameters. The parameters are characteristic parameters that describe, in particular, the process such as, for example, the necessary press force of the ram, and/or the ram stroke, and/or the ram velocity that is to be maintained as a function of position, and/or transfer times for placing a workpiece in the press or removing it therefrom.

In the first and the second operating modes, the eccentric drive is driven in an oscillating manner in the respectively prespecified angle region. In doing so, the eccentric does not rotate about the rotation axis of the eccentric drive but moves in an oscillating manner in a respectively prespecified angle region back and forth between two angles of rotation that delimit the angle region. Preferably, the two angle regions of the respective operating mode are selected in such a manner that the hinged joint is moved through an axis connecting the first bearing and the second bearing. If the hinged joint is located on this axis, the ram reaches its lower return point. If the eccentric were rotated once by 360°, the ram would reach its lower return point twice, namely, preferably once in the first angle region of the first operating mode and once in the second angle region of the second operating mode. Inasmuch as, in the first operating mode, the connecting rod assumes a different position relative to the levers than in the second operating mode when the ram is in its lower return point, different force and motion conditions arise in the different operating modes. In particular, different maximally achievable press forces as well as different ram velocities occur at the same rotational speeds of the eccentric. In accordance with the invention, this inequality is utilized for operating the press drive, without additional adjustment means, in two or three different operating modes. Adjustment means for adjusting the eccentricity, the rotation axis of the eccentric, the length of the connecting rod or the position of the first or second bearing can be omitted. Therefore, the press drive requires only a minimal number of components. It is designed in a very simple and robust manner. The minimal number of bearings and the omission of additional adjustment means reduces the play in the press drive to a minimum so that the ram can be repeatedly precisely positioned. The control unit can control or regulate the press force and/or the ram position. If a regulation is intended, appropriate position sensors and/or force sensors are provided.

In the third operating mode—provided there is one—the eccentric is driven so as to rotate about a rotation axis of the eccentric drive. In doing so, the eccentric circles the rotation axis fully in one direction of rotation and does not oscillate. This third operating mode is suitable, for example, for a forming task where the press force made available in the second operating mode is sufficient. Compared to the second operating mode, advantages may result such as, for example, when a large stroke is required or when a high output is more appropriate. The kinematic conditions due to the connecting rod and the two levers during a complete rotation of the eccentric about the rotation axis during the downward motion and the upward motion of the ram are different. This difference can be compensated for, or at least minimized, in that the motor rotation speed of the eccentric drive and thus the rotational speed of the eccentric about the rotation axis are changed during a rotation. Due to this measure, the same ram position can be reached, irrespective of the angle region in which the eccentric is moving.

In a fourth operating mode, a pendulum operation is performed. The eccentric drive is driven in an oscillating manner within a prespecified angle region. The eccentric moves back and forth in the angle region between two angles of rotation delimiting said angle region. In doing so, the angle region of the fourth operating mode is selected in such a manner that the hinged joint does not move through the axis that connects the first and the second bearings (extended position). Therefore, the region in which the ram moves in stroke direction does not include the lower return point that can be reached with the hinged joint in extended position. For example, the ram can oscillate in a section of the sinusoidal motion curve, in which section a large stroke movement of the ram is achieved with minimal rotation movements of the eccentric. This idea can also be implemented in gears other than the above-described eccentric gear, wherein the eccentrically supported and driven connecting rod is connected directly to the ram.

Preferably, the first angle region of the first operating mode and the second angle region of the second operating mode do not comprise an overlap region. The rotational position of the eccentric in the first angle region is always different from the rotational position of the eccentric in the second angle region. As a result of this, the two operating modes are totally different from each other.

The longitudinal axis of the connecting rod is understood to be the axis extending through the hinged joint as well as the linkage point of the connecting rod on the eccentric. If the ram in the first operating mode is located at the lower return point, the longitudinal axis of the connecting rod subtends a first angle with the axis connecting the first and the second bearing. Correspondingly, the longitudinal axis of the connecting rod subtends a second angle with this axis when the ram in the second operating mode is located at its lower return point. These two angles have different sizes. In one exemplary embodiment, the size of the first angle is preferably greater by a factor of at least 1.3 to 1.5 than the size of the second angle. Consequently, the inequality of the relationships in the two operating modes is particularly distinct.

Preferably, the ram velocity at the lower return point with the same rotational speed of the eccentric, is smaller in the first operating mode than in the second operating mode. With the same torque on the eccentric, the degree of the maximum press force in the first operating mode may be greater than the degree of the maximum press force in the second operating mode. The control unit can automatically select the suitable operating mode as a function of the parameters. The parameters may be prespecified via an operating unit by the operator or be detected during a test run by the control unit.

In a preferred exemplary embodiment, the control unit automatically sets the first operating mode when a maximum force of the press is imperative. In the preferred exemplary embodiment, the maximum achievable force of the ram in the first operating mode is greater than in the second operating mode. The kinematics of the press drive defined by the arrangement of the connecting rod and the two levers can be selected in such a manner that the two strokes are nearly equally big during a full rotation of the eccentric about the rotation axis. It is also possible to increase the stroke difference between the two strokes during a full rotation of the eccentric by changing the kinematics of the press drive. As a result of this, differences in view of the press force and the ram velocity in the first and second angle ranges can be increased. For example, the maximum press force in the first angle region is increased relative to the second angle region, and the ram velocity can be increased in the second angle region relative to the first angle region at the same eccentric rotational speed.

The control unit can automatically set the second operating mode when the required press force in the second operating mode can be reached. This increases the output of the press. The required press force can be pre-specified by an operator via the operating unit or be sensorically detected during a test run by performing at least one test stroke of the ram. As has already been mentioned, it is also possible for the control unit to detect additional parameters during the test run such as, for example, the workpiece transfer time.

The press drive can also be operated in more than the three so far explained operating modes. For example, it is possible to select one of a maximum of four achievable press forces depending on the forming task. The press forces may additionally be different in the first and second angle region, depending on from what direction, i.e., the direction of rotation of the eccentric about the eccentric rotation axis, the ram reaches its lower return point.

BRIEF DESCRIPTION OF THE DRAWINGS

Advantageous embodiments of the invention can be inferred from the description as well as from the dependent patent claims. The description is restricted to essential features of the invention. The drawings may be used for additional reference. Hereinafter the invention will be explained with the use of an exemplary embodiment and by making reference to the drawings. They show in:

DETAILED DESCRIPTION OF THE PARTICULAR EMBODIMENTS

Figure 1:
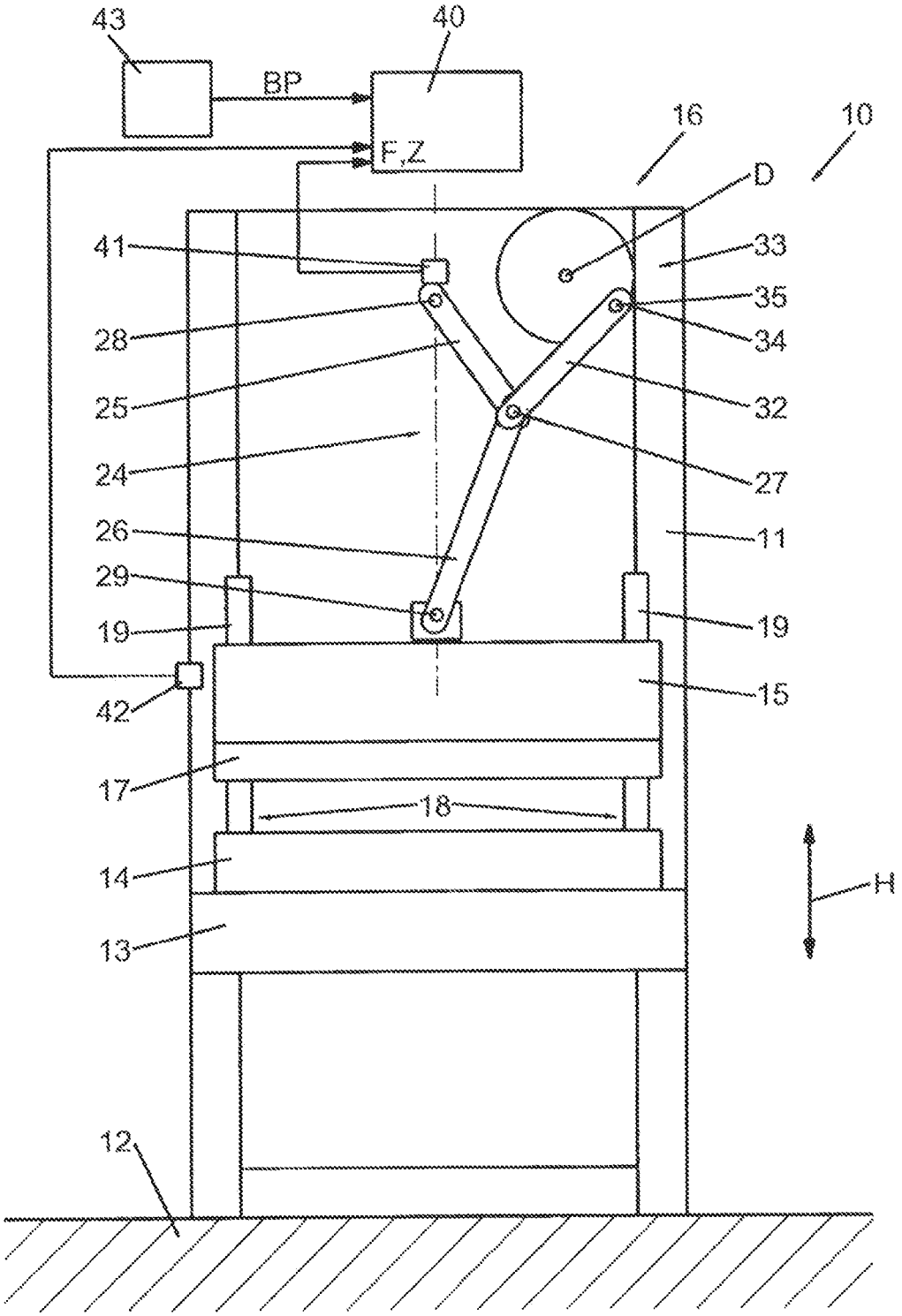
FIG. 1 a schematic representation in a manner similar to a block diagram, of a press with an exemplary embodiment of a press drive in accordance with the present invention.

FIG. 1 shows a press 10 represented in the manner of a simplified block diagram. The press 10 comprises a press frame 11 by means of which the press 10 is set, or mounted to, a supporting surface 12.

Furthermore, the press 10 comprises a press bed 13 on which is provided a lower tool 14.

A ram 15 of the press 10 can be moved back and forth in a stroke direction H by means of a press drive 16. The stroke direction H is preferably oriented in vertical direction. An upper tool part 17 may be provided on the ram 15, said tool part interacting with the lower tool part 14 in order to process, for example form, a workpiece. Via a guide device 18, the ram is movably supported in stroke direction H by the press frame 11 and/or by the press bed 13. The guide device 18 is schematically represented in FIG. 1 by two guide rails 19, along which the ram 15 is guided back and forth.

The press drive 16 comprises a knee lever gear 24. The knee lever gear 24 comprises a first lever 25 and a second lever 26 that are supported next to each other on a hinged joint 27 so that they can be pivoted together. The first lever 25 is supported by a first bearing 28 on its side opposite the hinge joint 27 so as to be pivotable on the press frame 11. The first bearing 28 is stationarily mounted to the press frame 11. The second lever 26 is connected, via a second bearing 29, so as to be pivotable with the ram 15.

Figure 2:
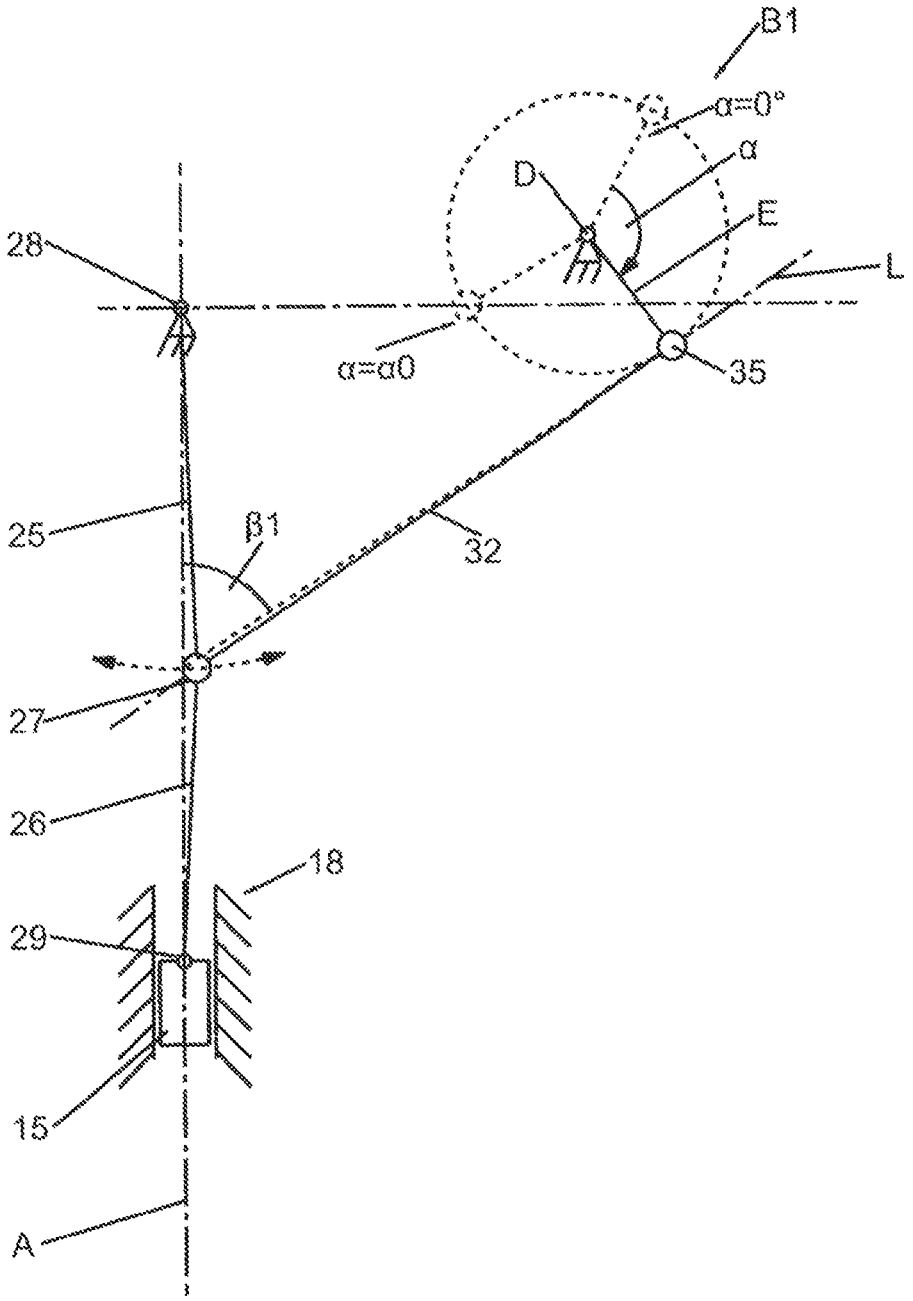
FIG. 2 a schematic diagram of a first exemplary embodiment of the press drive for a press in accordance with FIG. 1, in a first operating mode.
Figure 3:
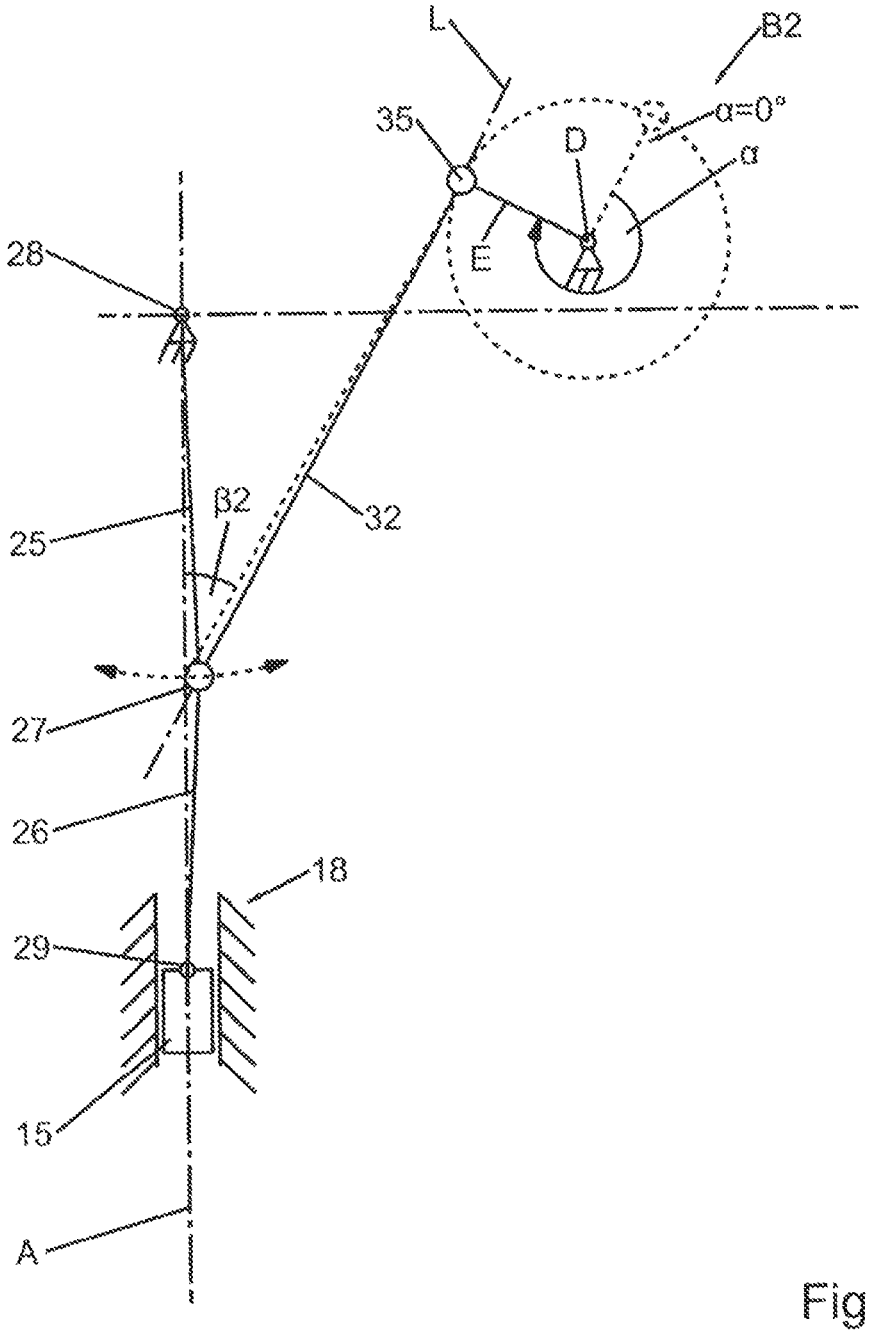
FIG. 3 a schematic diagram of the first exemplary embodiment of the press drive for a press, in a second operating mode.

A connecting rod 32 comes into engagement with the hinged joint 27. On its one end, the connecting rod 32 is arranged so as to be pivotable about the pivot axis of the hinged joint 27. The opposite end of the connecting rod 32 is associated with an eccentric drive 33 and thus represents the drive end 34 of the connecting rod 32. The drive end 34 is pivotally attached to an eccentric 35 of the eccentric drive 33. The eccentric 35 can be driven in a rotating manner and, in particular, in a rotation-oscillating manner, about a rotation axis D. The distance between the eccentric 35 and the rotation axis D is referred to as eccentricity E and cannot be changed (FIGS. 2 and 3). The eccentric drive 33 is mounted to the press frame 11. The position of the rotation axis D relative to the press frame cannot be changed in the case of the exemplary embodiment. Likewise, the lengths of the connecting rod 32 and the two levers 25, 26 are constant and cannot be changed by adjustment means. Consequently, the press drive 16 is designed in a technically simple manner.

Figure 4:
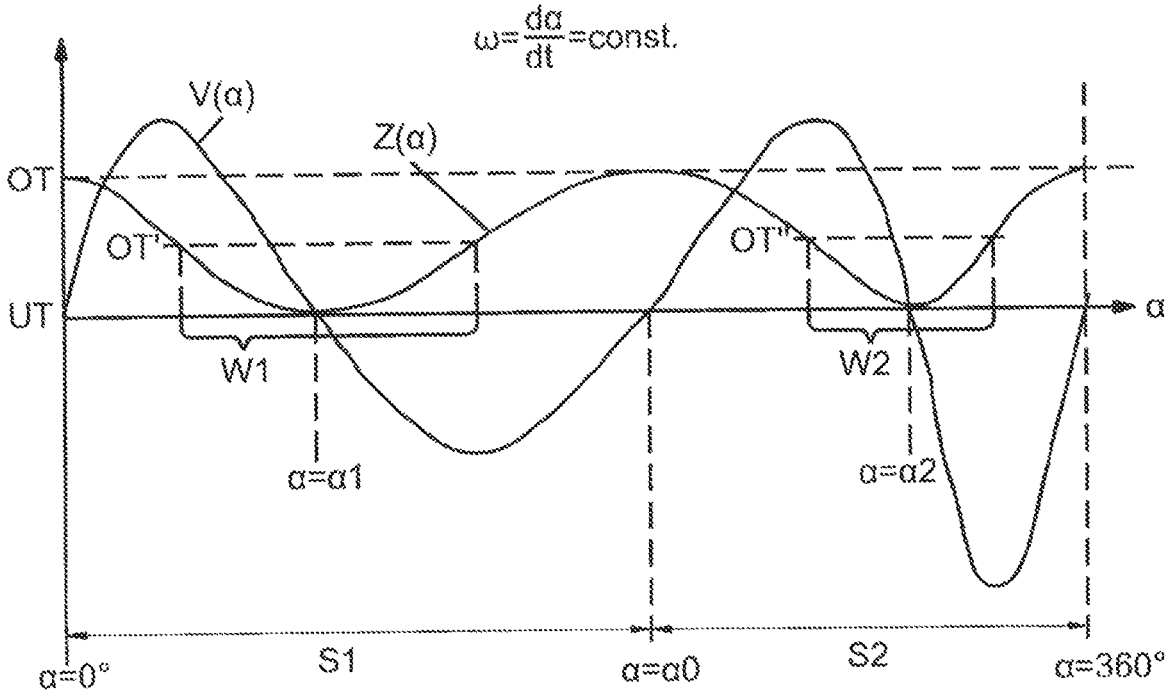
FIG. 4 the ram position and the ram velocity as a function of the rotational position of the eccentric about the rotation axis of the eccentric drive for the first exemplary embodiment of the press drive.
Figure 5:
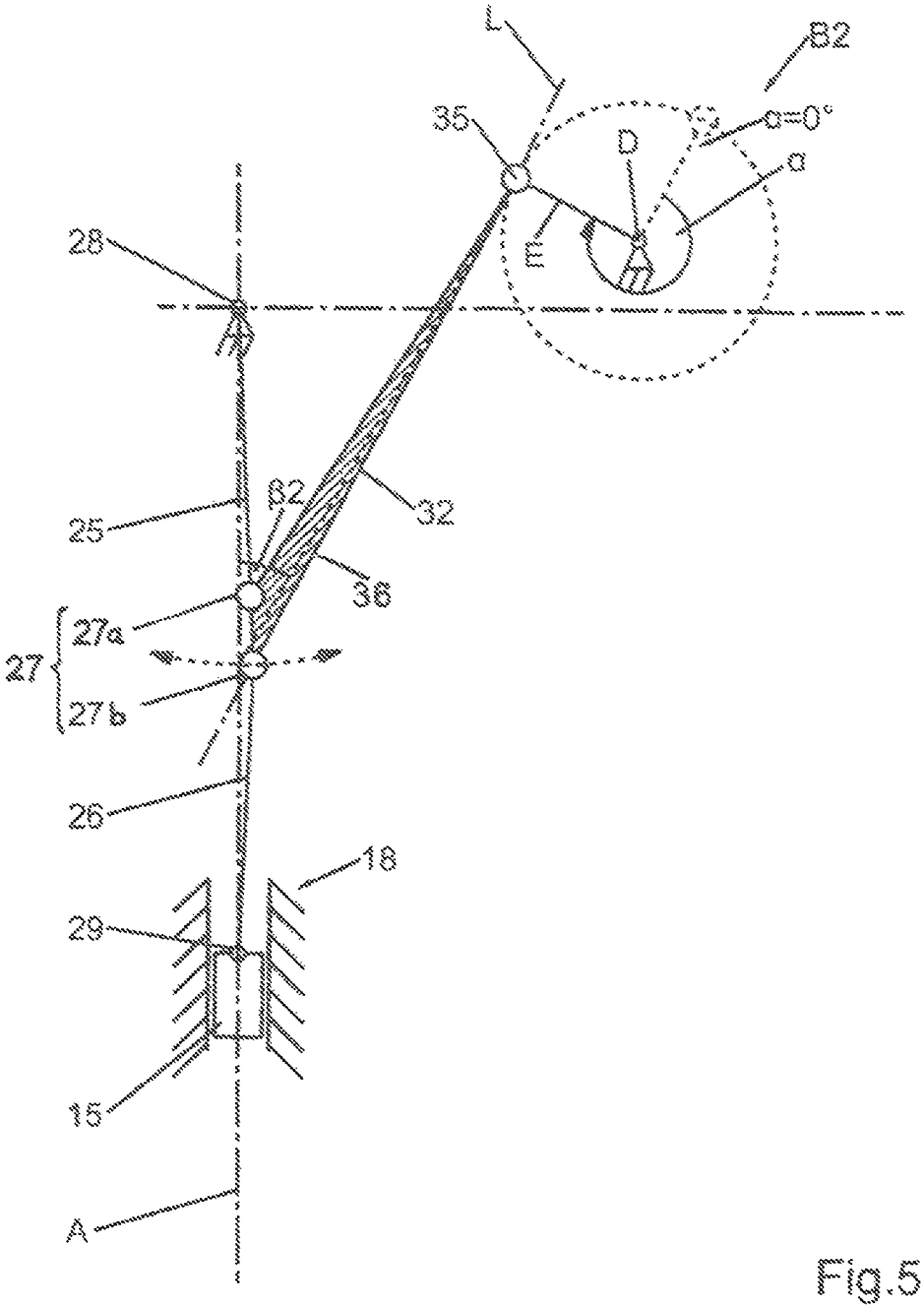
FIGS. 5 through 7 schematic diagrams of additional exemplary embodiments of the press drive for a press according to FIG. 1, each with a triangular control arm.
Figure 6:
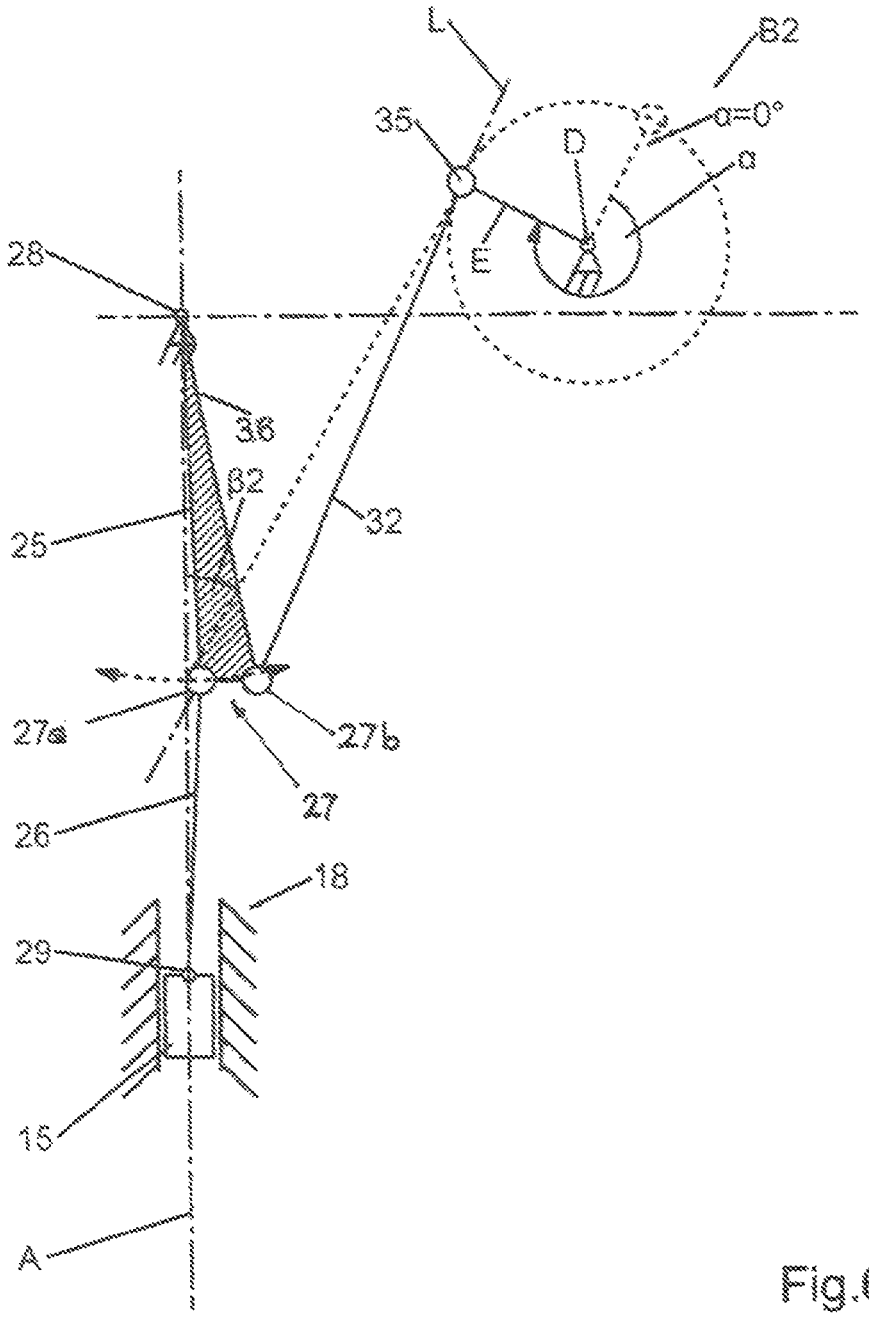
Figure 7:
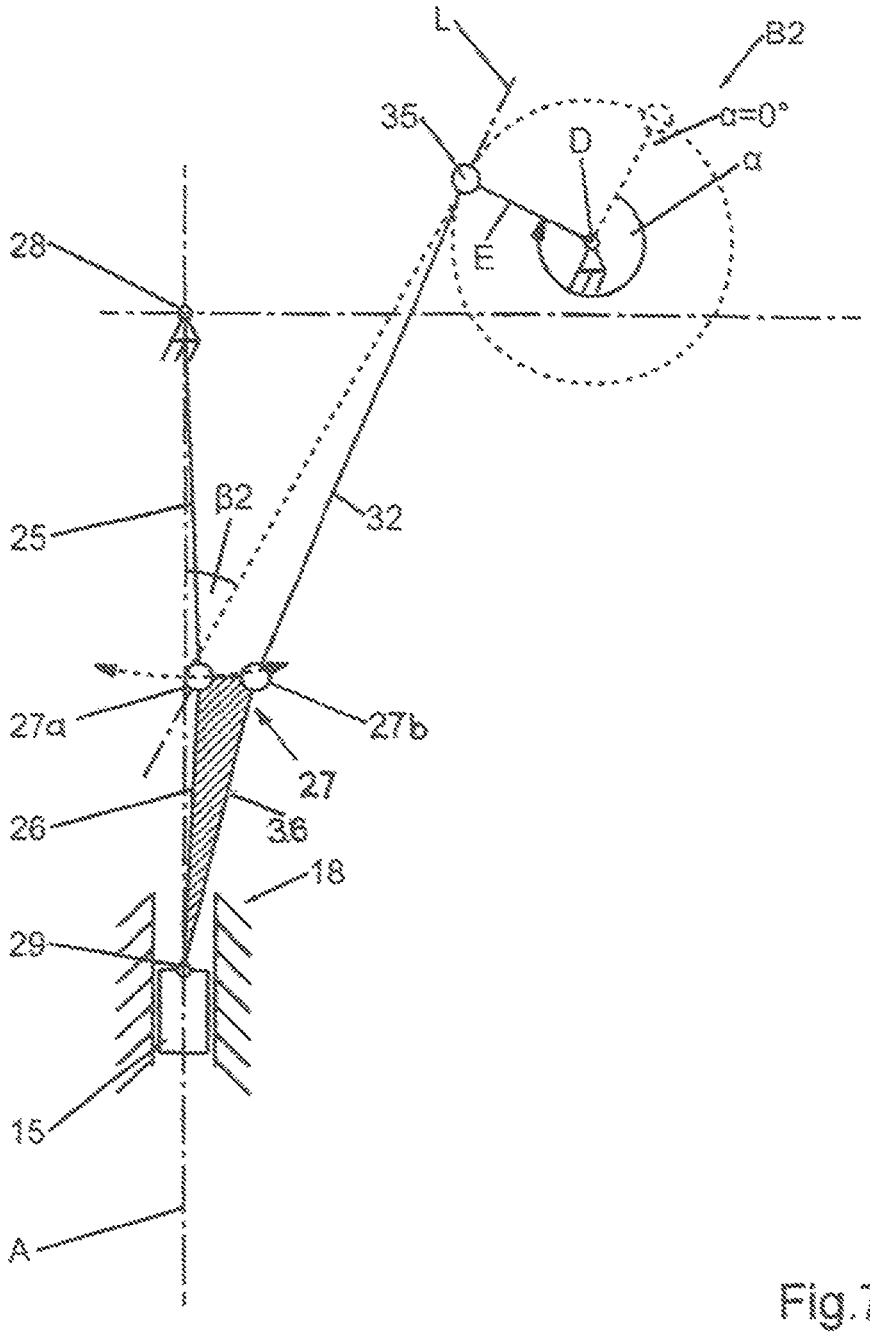

Each of FIGS. 5 through 7 shows an embodiment of the press drive 16 that has been modified compared to the exemplary embodiment of FIG. 3. In that case, the hinged joint 27 is formed by two linkage points 27*a*, 27*b*. In the extended position of the two levers 25, 26, the two linkage points 27*a*, 27*b* can be arranged approximately vertically or horizontally next to each other. Either the connecting rod 32 (FIG. 5) or the first lever 25 (FIG. 6) or the second lever 26 (FIG. 7) may be configured as the triangular control arm 36. The course of the movement of the ram as shown by FIG. 4 relates to the embodiment shown by FIG. 3 and changes depending on the kinematics of the press drive 16 defined by the arrangement and embodiment of the levers 25, 26 and the connecting rod 32.

The eccentric drive 33 is activated by a control unit 40. It pre-specifies the movement, as well as its chronological derivations such as the rotational speed $\omega$ or the angular acceleration. Furthermore, the control device 40 determines the torque of the eccentric drive 33. The latter may be embodied as an electric motor and, in particular, as a servo motor or torque motor. For example, the eccentric drive 33 may comprise an asynchronous machine and/or a gear, in particular a planetary gear. The control unit 40 may comprise an inverter for activating the eccentric drive 33.

Furthermore, the press drive 16 may comprise one or more sensors for detecting specific parameters during the operation of the press 10. In the present exemplary embodiment, a force sensor 41 is shown, said sensor being associated with the first bearing 28. With the aid of the sensor signal of the force sensor 41, it is possible for the control unit 40 to determine the actual press force F.

In the example, there is also a position sensor 42 whose sensor signal is transmitted to the control unit 40. With the aid of the sensor signal of the position sensor 42, it is possible to determine the ram position Z. It is also possible to provide the control device 40 with additional sensor signals or parameters.

In the exemplary embodiment described here, there is also an operating unit 43 by means of which an operator can input or prespecify operating parameters (BP). The operating parameters BP are conveyed to the control unit 40. The control unit 40 may be disposed for regulating the ram position Z and/or the press force F.

Considering the technical design of the press drive 16 in accordance with the present exemplary embodiment, the rotation axis D of the eccentric drive 33 in stroke direction H is located above the first bearing 28. The eccentricity E is selected in such a manner that the eccentric 35, viewed in stroke direction H, may be located above or below the first bearing 28, depending on the angle of rotation $\alpha$.

When the eccentric 35 rotates once fully about its rotation axis D (angle of rotation $\alpha=0°$ to $\alpha=360°$), the hinged joint 27 is moved twice through an axis A, said axis connecting the first bearing 28 and the second bearing 29. In other words, the hinged joint 28 assumes its extended position twice, in which position the two levers 25, 26 are aligned along axis A. In this extended position of the hinged joint 27, the ram 15 is at its lower return point UT. When the hinged joint 27 is at its greatest-possible distance from the axis A, the ram 15 is at its upper return point OT. In the diagram in accordance with FIG. 4, the definition provides that the ram 15 reaches its upper return point OT at $\alpha=0°$ (corresponds also to $\alpha=360°$) and at a first angle of rotation $\alpha 0$. The first angle of rotation $\alpha 0$ divides one complete rotation of the eccentric 35 into a first area S1 and a second area S2. In the first area S1, the ram 15 reaches its lower return point UT at a second angle of rotation $\alpha 1$ and, in the second area S2, the ram 15 reaches its lower return point UT at a third angle of rotation $\alpha 2$. Due to the kinematics of the knee lever gear 24, the movement of the ram 15 is not the same in the two areas S1, S2. This is due to the fact that the position of the connecting rod 32 relative to the two levers 25, 26 is different in both areas S1, S2.

The control unit 40 is disposed to operate the eccentric drive 16 in a first operating mode B1, a second operating mode B2 or a third operating mode B3. The first operating mode B1 is performed in such a manner that the eccentric 35 is driven in a rotation-oscillating manner in a first angle region W1 about the second angle of rotation $\alpha 1$. The first angle region W1 is located in the first area S1, and is at most as large as this first area S1. In the second operating mode B2, the eccentric 35 is driven in a rotation-oscillating manner about the rotation axis D in a second angle region W2 about the third angle of rotation $\alpha 2$. The second angle region W2 is located within the second area S2 and is at most as large as the second area S2. The size of the two angle regions W1 and W2 is a function of the required stroke of the ram 15. If the angle regions W1, W2 are smaller than the respectively associated area S1, S2, the maximum possible stroke of the ram 15 is not fully utilized and only a part of the motion characteristic $Z(\alpha)$ shown in FIG. 4 is utilized. The upper return point OT then shifts toward OT' or OT".

In the third operating mode B3, the eccentric 35 is driven in a pre-specified direction of rotation in manner so as to rotate about the rotation axis D. Consequently, the eccentric 35 moves on a circular orbit about the rotation axis D. During each orbit, the first, as well as the second, angle region W1, W2 is passed twice.

The longitudinal axis L of the connecting rod 32 connects the pivot axis of the joint hinge 27 with the pivot axis between the eccentric 35 and the drive end 34 of the connecting rod 32. If the angle of rotation $\alpha$ corresponds to the second angle of rotation $\alpha 1$, the ram 15 is in the first operating mode B1 at its lower return point UT. In the first operating mode B1, the longitudinal axis L and the axis A through the first bearing 28 and the second bearing 29 subtend a first angle $\beta 1$ (FIG. 2) when the ram 15 is at its lower return point UT. Correspondingly, in the second operating mode B2, the longitudinal axis L of the connecting rod 32 and the axis A subtend a second angle $\beta 2$ when the ram 15 is in the second operating mode B2 at its lower return point UT (FIG. 3). Respectively, the smaller angle between the longitudinal axis L and the axis A are measured as the first and second angles $\beta 1$ and $\beta 2$. The angles $\beta 1$ and $\beta 2$ are acute angles. The size of the first angle $\beta 1$ is larger and, in accordance with the example, larger by the factor of 1.3 to 1.5, than the size of the second angle $\beta 2$. For this reason, the maximum press force Fmax made available by the ram 15 at a specific torque of the eccentric drive 22 in the first operating mode B1 is greater than in the second operating mode B2.

The motion characteristic $Z(\alpha)$ is flatter in the first angle region W1 in the first operating mode B1 than in the second angle region W2 in the second operating mode B2. Therefore, the ram velocity V at the lower return point UT in the first operating mode B1 is lower than in the second operating mode B2. Therefore, a higher press force F of the ram 15 can be made available in the first operating mode B1. In the second operating mode B2, with the same stroke of the ram 15, it is possible to achieve greater stroke numbers due to the higher ram velocity V and thus a greater output of the press 10. FIG. 4 shows the ram velocity characteristic $V(\alpha)$ as a function of the angle of rotation $\alpha$.

In the present exemplary embodiment, the control unit 40 is designed to automatically selectively adjust the first operating mode B1 or the second operating mode B2 as a function of the detected and/or prespecified parameters P. The parameters P are those that have been prespecified via the operating unit 43, namely the parameters BP and/or parameters that have been sensorically detected such as, for example, the press force F, the ram position Z, the stroke number of the press, the stroke of the ram, the ram velocity, the transfer time for insertion and/or removal of a workpiece in or from the press 10, or similar parameters. The said parameters can be used in any desired combination. It is also possible that the control device 40 is switched into a test operating mode and that it sensorically detects at least a part of the required parameters P during one or more test strokes of the ram 15, and suggests a suitable operating mode B1, B2. This operating mode can be indicated and suggested to the operator by an operating unit 43, for example. The operator may then accept or decline the suggested operating mode.

Based on the kinematic dimensions and the maximum motor torque, it is possible to determine an available press force over the drawing path for the first and the second operating modes B1, B2. Considering the existing press force requirements in the operating mode that makes available the lower press force, a determination is made as to whether the output of the press—taking into consideration the boundary conditions prespecified by the operator—is greater with an oscillating movement of the ram in the second operating mode B2 or with a complete orbit of the eccentric in the third operating mode B3. The second operating mode B2 or the third operating mode B3 is selected accordingly. In doing so, it is preferably also taken into consideration whether the full ram stroke is needed or not. The boundary conditions prespecified by the operator are, for example, the ram velocities and/or the maximum ram velocities at certain points or in certain sections of the ram characteristic. If the press force requirement is greater, there remains only the stronger but slower first operating mode B1, and the calculated output can then only be accepted.

If conflicts between the sensorically detected parameters and the parameters BP pre-specified via the operating unit are detected, a suitable operating mode B1, B2 will be suggested by the control unit via the operating unit 43, and the conflict will be indicated.

The invention relates to a press drive 16 for a press 10 or a press 10 having a press drive 16. The invention also relates to a method for controlling the press drive 16 by means of a control unit 40. The press drive 16 is used for moving a ram 15 of the press in a stroke direction H between an upper return point OT and a lower return point UT. It comprises a knee lever gear 24 having a first lever 24 and a second lever 26. A connecting rod 32 engages on the knee lever 27 of the two levers 25, 26 and is connected on the other end 34 to an eccentric 35 of an eccentric drive 33. The control unit 40 can drive the eccentric drive 33 in a first operating mode B1 or a second operating mode B2 or, in particular, also a third operating mode B3. In the first and the second operating modes B1, B2, the eccentric oscillates in a respectively different angle region W1, W2 about a rotation axis D of the eccentric drive 33, thus resulting in different force and movement states of the ram 15 in both operating modes.

LIST OF REFERENCE SIGNS

10 Press
11 Press frame
12 Supporting surface
13 Press bed
14 Lower tool part
15 Ram
16 Press drive
17 Upper tool part
18 Guide device
19 Guide rail
24 Knee lever gear
25 First lever
26 Second lever
27 Hinged joint
27*a*, 27*b* Linkage point
28 First bearing
32 Connecting rod
33 Eccentric drive
34 Drive end
35 Eccentric
36 Triangular control arm
40 Control unit
41 Force sensor
42 Position sensor
43 Operating unit
α Angle of rotation
α0 First angle of rotation
α1 Second angle of rotation
α2 Third angle of rotation
β1 First angle
β2 Second angle
ω Rotational speed
A Axis
B1 First operating mode
B2 Second operating mode
B3 Third operating mode
BP Operating parameter
D Rotation axis
E Eccentricity
F Press force
L Longitudinal axis
OT Upper return point
S1 First area
S2 Second area
UT Lower return point
V Ram velocity
W1 First angle region
W2 Second angle region
Z Ram position

What is claimed is:

1. A press drive (16) for a press (10) comprising:

a knee lever gear (24) having a first lever (25) and a second lever (26) that are pivotally supported on a hinged joint (27), wherein the knee lever gear (24) has a first bearing (28) which supports the first lever (25) on a press frame (11), as well as a second bearing (29) at which the second lever (26) is connected to a rain (15) of the press (10);

a connecting rod (32) whose one end is pivotally supported on the hinged joint (27) and whose other end (34) is connected to an eccentric (35) of an eccentric drive (33), said eccentric being movable about a rotation axis (D);

a control device (40) is configured to activate and to drive the eccentric drive (33) in at least one of a first operating mode (B1) and a second operating mode (B2);

wherein the eccentric (35) is driven in a prespecified first angle region (W1) in a rotation-oscillating manner in the first operating mode (B1) and is driven in a rotation-oscillating manner in a prespecified second angle region (W2) in a second operating mode (B2);

the press drive (16) is configured such that the rain (15) reaches a lower return point (UT) of the rain (15) twice during a complete rotation of the eccentric (35) at a second angle of rotation (α1) and a third angle of rotation (α2);

in the first operating mode (B1) the eccentric (35) is driven in the rotation-oscillating manner in the first angle region (W1) about the second angle of rotation (α1) and in the second operating mode (B2) the eccentric (35) is driven in the rotation-oscillating manner in the second angle region (W2) about the third angle of rotation (α2);

a first angle (β1) is enclosed between a longitudinal axis (L) of the connecting rod (32) and an axis (A) connecting the first bearing (28) and the second bearing (29) when the rain (15) is at the lower return point (UT) in the first operating mode (B1) and a second angle (β2) is enclosed between the longitudinal axis (L) of the connecting rod (32) and the axis (A) connecting the first bearing (28) and the second bearing (29) when the rain (15) is at the lower return point (UT) in the second operating mode (B2);

for activating the eccentric drive (33), the control device (40) further includes a third operating mode (B3) for driving the eccentric drive (33) in which the eccentric (35) performs a full rotation about the rotation axis (D);

the two prespecified angle regions (W1, W2) do not have an overlap region;

the control device (40) is configured to automatically select and adjust at least one of the first operating mode (B1) and the second operating mode (B2) and the third operating mode (B3) in view of detected or pre-specified parameters.

2. The press drive of claim 1, characterized in that the hinged joint (27) is moved through the axis (A) connecting the first bearing (28) and the second bearing (29) in one of the first, second or third operating modes (B1, B2, B3).

3. The press drive of claim 1, characterized in that the hinged joint (27) is moved at most up to the axis (A) connecting the first bearing (28) and the second bearing (29) in one of the first, second or third operating modes (B1, B2, B3).

4. The press drive of claim 1, characterized in that the control device (40) is configured to activate and to drive the eccentric drive (33) in a fourth operating mode or in the first operating mode (B1) or the second operating mode (B2) such that the eccentric (35) of the eccentric drive (33) is driven in an oscillating manner in a prespecified angle region, in which case the hinged joint (27) neither reaches the axis (A) connecting the first bearing (28) and the second bearing (29) nor is said hinged joint (27) moved through said axis (A).

5. The press drive of claim 1, wherein the first angle (β1) and the second angle (β2) have different sizes.

6. The press drive of claim 5, characterized in that the size of the first angle (β1) is greater than the size of the second angle (β2).

7. The press drive of claim 1, characterized in that a rain velocity (V) about the lower return point (UT), with the same rotational speed (co) of the eccentric (35), is lower in the first operating mode (B1) than in the second operating mode (B2).

8. The press drive of claim 1, characterized in that the first bearing (28) is non-displaceably arranged on the press frame (11).

9. The press drive of claim 1, characterized in that at least one of the lengths of the two levers (25, 26) and the length of the connecting rod (32) are unchangeable.

10. The press drive of claim 1, characterized in that at least one of the position of the rotation axis (D) of the eccentric drive (33) relative to the press frame (11) and the eccentricity (E) of said eccentric (35) are unchangeable.

11. The press drive of claim 1, characterized in that one of the first lever (25) or the second lever (26) or connecting rod (32) is configured as a triangular control arm (36) having three linkage points.

12. The press drive of claim 11, wherein the triangular control arm (36) includes a hinged joint (27) having a pivot axis proximate each of a first spaced apart linkage point (27*a*) and a second spaced apart linkage point (27*b*).

13. The press drive of claim 12, wherein the pivot axes of the hinged joint (27) proximate the first spaced apart linkage point (27*a*) and the second space apart linkage point (27*b*) extend parallel to each other.

14. The press drive of claim 12, wherein when the first lever (25) is configured as the triangular control arm (36), the second lever (26) comes into engagement at the first spaced apart linkage point (27*a*) and the connecting rod (32) comes into engagement at the second spaced apart linkage point (27*b*).

15. The press drive of claim 12, wherein when the second lever (26) is configured as the triangular control arm (36), the first lever (25) comes into engagement at the first spaced apart linkage point (27*a*) and the connecting rod (32) comes into engagement at the second spaced apart linkage point (27*b*).

16. The press drive of claim 12, wherein when the connecting rod (32) is configured as the triangular control arm (36), the first lever (25) comes into engagement at the first spaced apart linkage point (27*a*) and the second lever (26) comes into engagement at the second spaced apart linkage point (27*b*).

* * * * *